US010557244B2

(12) United States Patent
Kuivamäki et al.

(10) Patent No.: US 10,557,244 B2
(45) Date of Patent: Feb. 11, 2020

(54) HAMMERING DEVICE

(71) Applicants: MOVAX OY, Hämeenlinna (FI); Lotta Borgenström, Hyvinkää (FI)

(72) Inventors: Pentti Kuivamäki, Hyvinkää (FI); Mikko Lindeman, Hämeenlinna (FI)

(73) Assignee: MOVAX OY, Hämeenlinna (FI)

( * ) Notice: Subject to any disclaimer, the term of this patent is extended or adjusted under 35 U.S.C. 154(b) by 396 days.

(21) Appl. No.: 15/127,146

(22) PCT Filed: Mar. 19, 2015

(86) PCT No.: PCT/FI2015/000010
§ 371 (c)(1),
(2) Date: Sep. 19, 2016

(87) PCT Pub. No.: WO2015/140390
PCT Pub. Date: Sep. 24, 2015

(65) Prior Publication Data

US 2017/0107681 A1 Apr. 20, 2017

(30) Foreign Application Priority Data

Mar. 19, 2014 (FI) ..... 20140081

(51) Int. Cl.
*E02D 7/18* (2006.01)
*B25D 9/12* (2006.01)

(52) U.S. Cl.
CPC *E02D 7/18* (2013.01); *B25D 9/12* (2013.01)

(58) Field of Classification Search
CPC ..... B25D 17/24; B25D 11/04; B25D 9/12; B25B 21/02; E02D 5/526; E02D 7/18; B06B 1/16
USPC ..... 173/104, 200, 184
See application file for complete search history.

(56) References Cited

U.S. PATENT DOCUMENTS 3,552,320 A * 1/1971 Traupmann ..... E01B 29/20 104/17.1
3,714,892 A * 2/1973 Perry ..... B41J 9/133 101/93.48
3,735,822 A * 5/1973 Deike ..... B25D 1/16 144/195.5

(Continued)

FOREIGN PATENT DOCUMENTS

CN 2911013 Y 6/2007
EP 0449286 A1 10/1991

(Continued)

OTHER PUBLICATIONS

Finnish Patent and Registration Office Search report of Finnish Patent Application No. 20140081, dated Nov. 5, 2014.

(Continued)

*Primary Examiner* — Robert F Long
(74) *Attorney, Agent, or Firm* — Berggren LLP

(57) ABSTRACT

A hammering device enabling an increased hammering effect to an object is provided. The device has a fork-shaped first frame having series of suspension organs on the inner surfaces of the forks. The hammering device has a second frame that forms a frame for two vibrators and includes a gripping jaw locating on movable turning bars. The vibrators are coupled to the first frame by the suspension organs and locate on both sides of the gripping jaws.

9 Claims, 1 Drawing Sheet

(56) References Cited

U.S. PATENT DOCUMENTS 3,871,528 A * 3/1975 Wilkinson ..... B66C 23/90 212/277
4,139,067 A * 2/1979 Craig ..... A01G 17/16 173/100
4,446,930 A * 5/1984 Nilsson ..... B25D 17/08 173/132
5,191,840 A * 3/1993 Cotic ..... E01B 29/26 104/17.1
5,234,282 A * 8/1993 Osborn ..... E01C 23/122 299/37.3
5,292,220 A * 3/1994 Cartner ..... E02F 3/627 414/687
5,639,119 A * 6/1997 Plate ..... B60G 9/02 280/124.112
6,315,059 B1 * 11/2001 Geldean ..... E21B 7/028 173/112
6,776,242 B1 * 8/2004 Cunningham ..... E04H 17/263 173/124
7,018,257 B2 * 3/2006 Courtney ..... B63C 9/24 222/5
7,059,423 B1 * 6/2006 Hoggarth ..... B25D 11/06 173/114
7,854,571 B1 12/2010 Evarts
8,985,908 B2 3/2015 Kuivamäki
9,157,253 B2 * 10/2015 Rohrer, Jr. ..... E04H 17/26
2005/0056485 A1 * 3/2005 Tarlow ..... E06C 7/14 182/129
2006/0213676 A1 * 9/2006 Jinnings ..... E02D 7/10 173/184
2007/0246436 A1 * 10/2007 Picard ..... B60P 1/5433 212/292
2009/0089991 A1 * 4/2009 Saprykin ..... B25B 27/0035 29/218
2011/0162859 A1 * 7/2011 White ..... E02D 7/125 173/1
2011/0198104 A1 * 8/2011 Stockstill ..... B25D 17/02 173/128
2011/0308421 A1 * 12/2011 Pritzl ..... E01B 29/32 104/17.2
2014/0037415 A1 * 2/2014 Zuritis ..... E02F 3/06 414/695.5
2015/0053449 A1 * 2/2015 Henke ..... E01B 29/26 173/128
2015/0217419 A1 * 8/2015 Whitmer ..... E04H 17/263 173/128
2015/0367492 A1 * 12/2015 Lindell ..... B25D 17/24 173/211
2017/0095920 A1 * 4/2017 Lindell ..... B25D 17/24

FOREIGN PATENT DOCUMENTS

JP S58123920 A 7/1983
JP 2000017659 A 1/2000
JP 2006257849 A 9/2006
JP 2010196455 A 9/2010
KR 100726812 B1 6/2007
RU 61723 U1 3/2007
RU 2011146539 A 5/2013
SU 605886 A1 5/1978
SU 1441025 A1 11/1988
WO 2013124525 A1 8/2013
WO 2013132138 A1 9/2013

OTHER PUBLICATIONS

Federal Service for Intellectual Property, Allowance notification from Russian Patent Office dated Sep. 5, 2018, 10 original pages, 4 pages translated.

* cited by examiner

HAMMERING DEVICE

PRIORITY

This application is a U.S. national application of PCT-application PCT/FI2015/000010 filed on Mar. 19, 2015 and claiming priority of the Finnish national application number FI 20140081 filed on Mar. 19, 2014, the contents of all of which are incorporated herein by reference.

FIELD OF THE INVENTION

The invention relates to a hammering device which can be coupled to a working machine, said device comprising a first frame, said frame having means for attaching to the working machine and to the frame coupled at a distance from each other locating series suspension means, via which as a frame for vibrators working second frame can be attached to the first frame, wherein said second frame comprises vibrators and gripping jaws for gripping to an object, wherein the gripping jaws locate on turning jaw bars wherein said bars can be moved by means of hydraulic cylinder and that the first frame is like a forking frame of U-form coupled to the attachment means, which has suspension means on the inner surfaces of both forks, via which suspension means the second frame has been attached to the first frame.

BACKGROUND OF THE INVENTION

A hammering device according to the above preamble is previously known from published Finnish applications FI-20100161 and FI-20120026 where the object to be hammered can be gripped with side grip and hammering force is transferred to the object via jaw bars of the gripping jaws. In these solutions vibrator device has been placed essentially deviating from the vertical line which goes via longish object to be hammered and which would be the most effective hammering line. This deviation causes loads to the construction of the hammering device and also reduces the hammering effect.

SUMMARY OF THE INVENTION

In order to remove these disadvantages, a new hammering device has been developed by means of which device the above described disadvantages and drawbacks can be avoided. It is characteristic of the invention that the second frame is directed both backwards and downwards along the portion so that the articulation points of the turning jaw bars fitted in the second frame can be located in such a position that the gripping jaws which are belonging to the ends of the jaw bars which have been attached to said articulating points locate centric in relation to said vibrators and suspension means.

The advantage of the invention is the fact that also in the hammering by means of side grip centric hammerings can be obtained when there are two vibrator devices, one device in both sides of the object to be hammered so, that their common hammering line goes to the object via in the grip situation working gripping organs. An advantage is further that also suspended attachment organs coupling the vibrator devices to the frame of the hammering device are placed centric in both sides of the gripping jaws which are transferring the hammerings to the object. In this case in the side grip gripping no inclined directed forces are produced which forces will try to turn gripping jaws when being in the grip during the hammering. The hammering also are effecting with full power to the object. Further by means of the working machine the hammering device can be easily kept in the intended hammering line when there are not existing inclined directed forces which turn the object during hammering.

BRIEF DESCRIPTION OF THE DRAWINGS

In the following the invention is described more detailed by referring to the attached drawings in which.

DETAILED DESCRIPTION OF THE INVENTION

Figure 1:
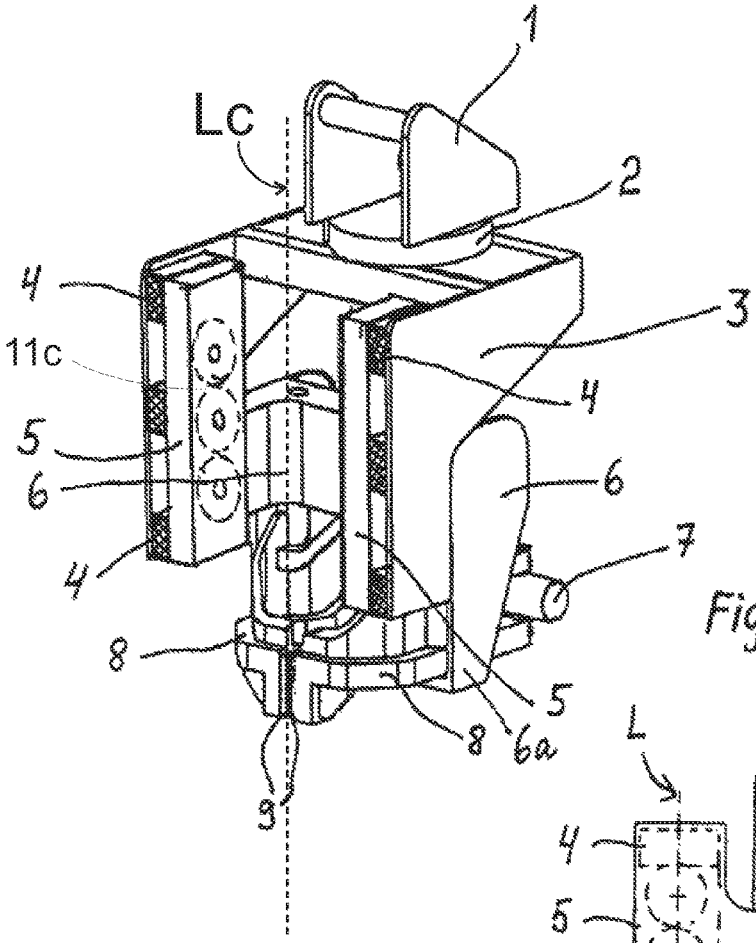
FIG. 1 shows a hammering device according to the invention seen from the side.
Figure 4:
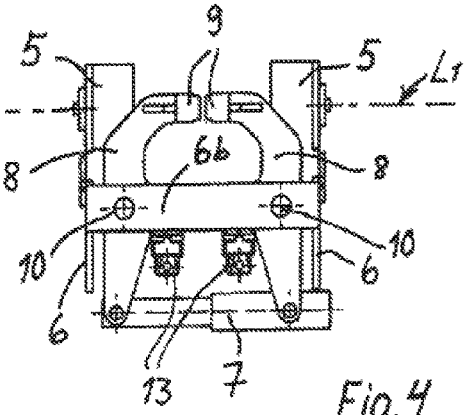
FIG. 4 shows a hammering device according to the FIG. 3 seen from below.

In FIG. 1 there is shown a hammering device which is attached to a working machine by means of an attachment means 1. Between the hammering device and attachment means a rotation device 2 has been in this case still fitted for rotating the hammering device round its vertical axis. Below the rotation device 2 there is first frame 3 of the hammering device, which is forking to two forks as U-form so, that both forks are ending to series of suspension organs, which are formed of several suspension organs 4. Two vibrators 5 belonging to the second frame 6 have been attached to the suspension organs 4. The second frame 6 hangs by means of the vibrators 5 from the first frame 3. The second frame 6 extends both rearwards and downwards to a portion **6*a* and there has been by means of a cylinder 7 moved gripping jaws 9 attached on the lower level in relation to vibrators 5 said jaws having articulation points 10 (FIG. 4). The gripping jaws 9 locate in the ends of the jaw bars 8** for gripping to the hammered object.

Figure 2:
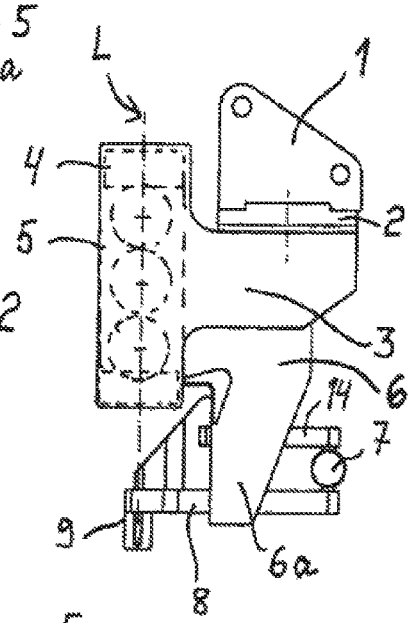
FIG. 2 shows a hammering device seen from the side.

FIG. 2 shows, how U-formed first frame 3 locates outer with its forking sides and the upper part of the second frame 6 locates inside the forking sides. In FIG. 2 there is shown, how the suspension organs 4, vibrators 5 and the gripping jaws 9 all locate in the same line L. Vibrators 5 and series of the suspension organs locate, however, in both sides of the line L, not direct in the line L, but the impact lines of both they together being one common line locates in the line L, because they locate centric in relation to the line L. The hammering force is so transferred also when hammered by side grip in the direction of the object to the object, not causing harmful side forces or not turning effort to the jaw bars 8 in the grip.

Figure 3:
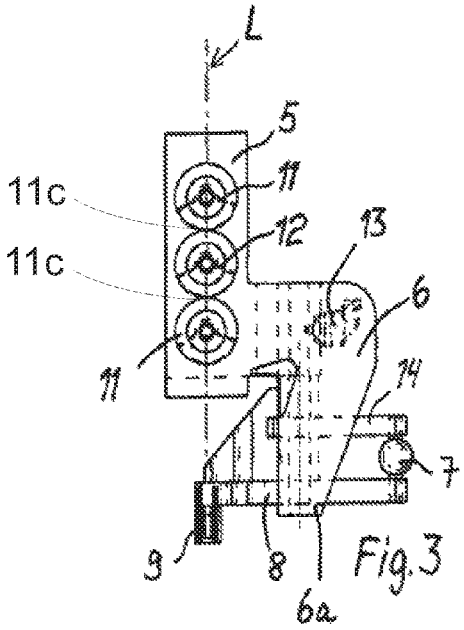
FIG. 3 shows a hammering device as the first frame removed.

FIG. 3 shows the device as the first frame 3 removed, wherein the vibrator alone is presented. In this embodiment both vibrators have three rotatable masses 11, 12 one on the other. The mass 12 in the middle can be twice compared with the masses 11, wherein the side forces have been compensated. In the vertical direction a maximum vibrator force is achieved.

Masses 11, 12 are rotated by a hydraulic motor 13. Above the jaw bar 8 there is another bar 14, in order a pure turning force is obtained for the articulation points 10.

FIG. 4 shows the vibrator seen from below. Also here a line L1 can be found, which line goes via the gripping organs and the vibrators 5. A portion **6*b* joins the lower parts 6*a* of the second frame 6**.

In one embodiment both vibrators have only two eccentric masses. In this case they are placed in vibrator housing side by side in horizontal direction and rotated in different directions. The eccentric masses are mounted so that the line L goes between them i.e. via the point of their cog contact. This solution increases dimensions of the vibrator housing causing increased lengths for the forks in the U-form. If this is allowed this solution is also usable.

In another embodiment both vibrator housings have only one eccentric mass. In this case the rotation axis of both eccentric masses has same direction than the fork of the first frame 3 has and the eccentric masses are rotated in the opposite directions. This solution causes increased distance between the forks in the frame 3. And this causes increased bread for the whole hammering device.

The object can be hammered both from top and by means of the side grip.

The invention claimed is:

1. A hammering device which can be coupled to a working machine, comprising a first frame and a second frame, the first frame having a forked shape with two forks and having attachment means for attaching the hammering device to the working machine the first frame further having a series of suspension organs on inner surfaces of the two forks, wherein said second frame comprises two vibrators, and gripping jaws for gripping an object, the gripping jaws locating in the first end of turning jaw bars, wherein said bars can be moved by means of a hydraulic cylinder, the second frame being attached via the suspension organs to the first frame, wherein the second frame extends to a first direction parallel to a center line and a second direction perpendicular to the center line so that said jaw bars are attached to articulation points such that the suspension organs, the vibrators and the gripping jaws all locate on a same plane, and the vibrators and the suspension organs locate centric on both sides of said center line, thereby arranging a hammering force of the hammering device to be transferred from the vibrators to the turning jaw bars via the articulation points of the turning jaw bars.

2. The hammering device according to the claim 1, wherein the vibrators are located on both sides of the gripping jaws so that their common middle line of vertical forces goes via gripping line of the gripping jaws.

3. The hammering device according to the claim 1, wherein both vibrators have at least one rotatable eccentric mass.

4. The hammering device according to the claim 1, wherein both vibrators have at least three or more rotatable eccentric masses in same vertical line.

5. The hammering device according to the claim 1, wherein the articulation points are located in the second frame on a lower height level than the vibrators.

6. The hammering device according to the claim 1, wherein the hammering device can be fitted to hammer the object from top and to grip the object via side grip and to hammer by means of side grip.

7. The hammering device according to the claim 1, wherein the vibrators are placed as first equipment beside both series of the suspension means wherein the second frame is fitted to extend from both vibrators to the attachment points of the jaw bars.

8. The hammering device according to the claim 1, wherein both vibrators comprise only two eccentric masses side by side, wherein the eccentric masses of each vibrator are in a cog contact, and the eccentric masses are mounted so that the line, on which the suspension organs, the vibrators and the gripping jaws locate, goes between the two eccentric masses of a vibrator, via the point of their cog contact.

9. The hammering device according to the claim 1, wherein the vibrator comprises vibrator housings, and both vibrator housings have only one eccentric mass.

* * * * *